United States Patent [19]

Lesensky

[11] Patent Number: 4,764,947

[45] Date of Patent: Aug. 16, 1988

[54] CATHODE FOCUSING ARRANGEMENT

[75] Inventor: Leonard Lesensky, Stamford, Conn.

[73] Assignee: The Machlett Laboratories, Incorporated, Stamford, Conn.

[21] Appl. No.: 804,428

[22] Filed: Dec. 4, 1985

[51] Int. Cl.[4] ..... H05J 35/14; H05J 35/06

[52] U.S. Cl. ..... 378/138; 378/136; 313/452

[58] Field of Search ..... 378/138, 113, 140, 136; 313/452, 453, 454; 315/39; 250/396 R

[56] References Cited

U.S. PATENT DOCUMENTS

| | | | |
|---|---|---|---|
| 1,923,876 | 8/1933 | Mutscheller . | |
| 2,921,214 | 1/1960 | Broad | 378/138 |
| 3,154,711 | 10/1964 | Beggs . | |
| 3,646,379 | 2/1972 | Garewal . | |
| 3,743,836 | 7/1973 | Holland et al. . | |
| 3,783,333 | 1/1974 | Altee . | |
| 3,962,583 | 6/1976 | Holland et al. | 250/402 |
| 4,065,690 | 12/1977 | Maeyama | 378/138 |
| 4,213,048 | 7/1980 | Quang . | |
| 4,373,144 | 2/1983 | Franke | 378/136 |

FOREIGN PATENT DOCUMENTS

| | | | |
|---|---|---|---|
| 0096824 | 7/1983 | European Pat. Off. . | |
| 3001141 | 7/1981 | Fed. Rep. of Germany | 378/136 |
| 3342127 | 6/1984 | Fed. Rep. of Germany | 378/138 |
| 424822 | 2/1935 | United Kingdom . | |
| 930673 | 2/1960 | United Kingdom . | |
| 1070503 | 12/1963 | United Kingdom . | |
| 1490463 | 1/1976 | United Kingdom . | |
| 2020482 | 5/1979 | United Kingdom . | |

*Primary Examiner*—Carolyn E. Fields
*Assistant Examiner*—Joseph A. Hynds
*Attorney, Agent, or Firm*—Richard M. Sharkansky

[57] ABSTRACT

An x-ray tube having an improved focusing arrangement is provided. The x-ray tube includes an evacuated envelope and an anode disposed within the envelope. A positive electrical potential, with respect to ground, is applied to the anode. A filamentary cathode emits an electron beam toward the anode. A first negative electrical potential, with respect to ground, is coupled to the filament and to an electrically conductive cathode body, which focuses the electron beam onto the anode at a focal spot, the focal spot having a length, corresponding to the length of the filament, and a width. The cathode body has an opening disposed therein and supports the filament in such opening. An electrode is insulatingly disposed in the opening of the body and applied with a negative electrical potential with respect to the first negative potential. With such arrangement, electron emissions from selected portions of the filaments are suppressed by apparatus displaced from the path of the electron beam, thereby reducing the width of the electron beam focal spot, and hence the area of such focal spot, while maintaining the total current of the electron beam substantially unchanged.

21 Claims, 5 Drawing Sheets

CATHODE FOCUSING ARRANGEMENT

BACKGROUND OF THE INVENTION

This invention relates to focusing arrangements for electron beam emitting cathodes and more particularly to apparatus for focusing such electron beams onto an anode in x-ray tubes.

As is known in the art, in typical x-ray tubes x-rays are generated by bombarding a target area, typically comprising a tungsten-rhenium (W-Re) alloy, of an anode made from suitable metal, such as titanium-zirconium-molybdenum (TZM), with an electron beam generated by a cathode. Typically, the cathode comprises a helical-shaped filament, transversely disposed with respect to the anode, with the length dimension of the filament positioned substantially parallel to the anode target area. The filamentary cathode is heated to electron-emissive temperatures by passing an alternating current (i.e., AC) electrical signal therethrough, such AC signal typically riding on a high negative DC potential with respect to ground. The anode, which may be a rotating anode, is commonly held at a high positive DC potential with respect to ground to thereby create a large potential difference (for example, approximately 120 KVDC) between the cathode filament and the anode. The helical filament is conventionally supported within an opening in an electrically conductive body portion of the cathode. The body portion is held at a predetermined electrical potential with respect to ground, typically at approximately the same negative DC potential as that applied to the filament, to electrostatically focus the beam of electrons emitted by the cathode filament onto a predetermined region, commonly referred to as the electron beam focal spot, of the anode target area, from which x-rays are emitted. The focused electron beam has a generally rectangularly-shaped electron distribution at the electron beam focal spot, the length of which corresponds to the filament length and the width of which comprises a central portion, referred to as the A-distribution, and a pair of peripheral portions, known collectively as the B-distribution, located on either side of the central portion.

Often, it is desirable to limit the electron beam focal spot to the smallest possible size, since this results in the highest resolution x-ray imaging. Prior art systems have variously altered the geometry of the cathode body opening, the location of the filament within the opening, the spacing between the filamentary cathode and the anode, and the biasing potential on the cathode body in an attempt to coalesce the A-distribution and B-distribution at the electron beam focal spot to thereby reduce electron beam focal spot size. One such prior art system includes an opening comprising a small slot disposed in a larger slot within the cathode body, with the helical filament being disposed near the junction of the two slots. While such a system has operated satisfactorily in some applications, other applications require electron beam focal spot area smaller than the electron beam focal spot area that such prior art system provides Another system, described in U.S. Pat. No. 3,646,379, entitled, "X-Ray Tube Having Controllable Focal Spot Size" and assigned to the present assignee, further disposes a pair of metal tabs, biased at zero or negative potential with respect to the filamentary cathode, at selected positions between the filament and the anode in the path of the electron beam emitted by the filament. While such system functions satisfactorily in some applications, the apparatus reduces the length of the electron beam focal spot while not significantly reducing the width thereof. That is, such apparatus does not substantially reduce the B-distribution from the electron beam focal spot and, moreover, reduces the electron beam current by blocking significant portions of the filamentary cathode along the length thereof from the anode.

SUMMARY OF THE INVENTION

In accordance with the present invention, a cathode assembly is provided comprising: means for emitting an electron beam in a path toward an anode; and, means for focusing the emitted electron beam onto a predetermined focal spot on the anode, the focusing means comprising means, displaced from the path, for suppressing emission of electrons from selected portions of the electron beam emitting means. With such arrangement, the focal spot area on the anode is reduced without significant reduction in electron beam current.

In a preferred embodiment of the present invention, the cathode assembly comprises a filament having a first electrical potential applied thereto. An electrically conductive body having an opening disposed therein supports the filament within the opening. A first region of the body is biased to a second electrical potential with respect to the first electrical potential, and a second region of the body, electrically isolated from the first region, is biased at the third electrical potential with respect to the first electrical potential, the third electrical potential being negative with respect to the first electrical potential.

According to the invention, an x-ray tube is provided comprising an evacuated envelope having disposed therein an anode and a cathode. The cathode comprises filamentary means for emitting an electron beam toward a target area of the anode, the filamentary means having a first electrical potential applied thereto. The emitted electron beam is incident on an electron beam focal spot of the anode target area, the electron beam focal spot having a length corresponding to the length of the filament and a width. A cathode body having first and second adjoining cavities disposed therein supports the filamentary means in the first and second cavities. The cathode body comprises a first electrode disposed adjacent to the first cavity and a second electrode disposed adjacent to the second cavity, the first and second electrodes being electrically isolated from each other. Means are included for applying a second electrical potential to the first electrode and a third electrical potential to the second electrode, the third electrical potential being negative with respect to the first electrical potential. With such arrangement, the B-distribution of the focused electron beam is substantially eliminated, thereby reducing the width of the electron beam focal spot, and hence the size of such focal spot, while maintaining total electron beam current substantially unchanged.

BRIEF DESCRIPTION OF THE DRAWINGS

The foregoing features of the present invention and the advantages thereof may be fully understood from the following detailed description read in conjunction with the accompanying drawings wherein.

DESCRIPTION OF THE PREFERRED EMBODIMENT

Figure 1:
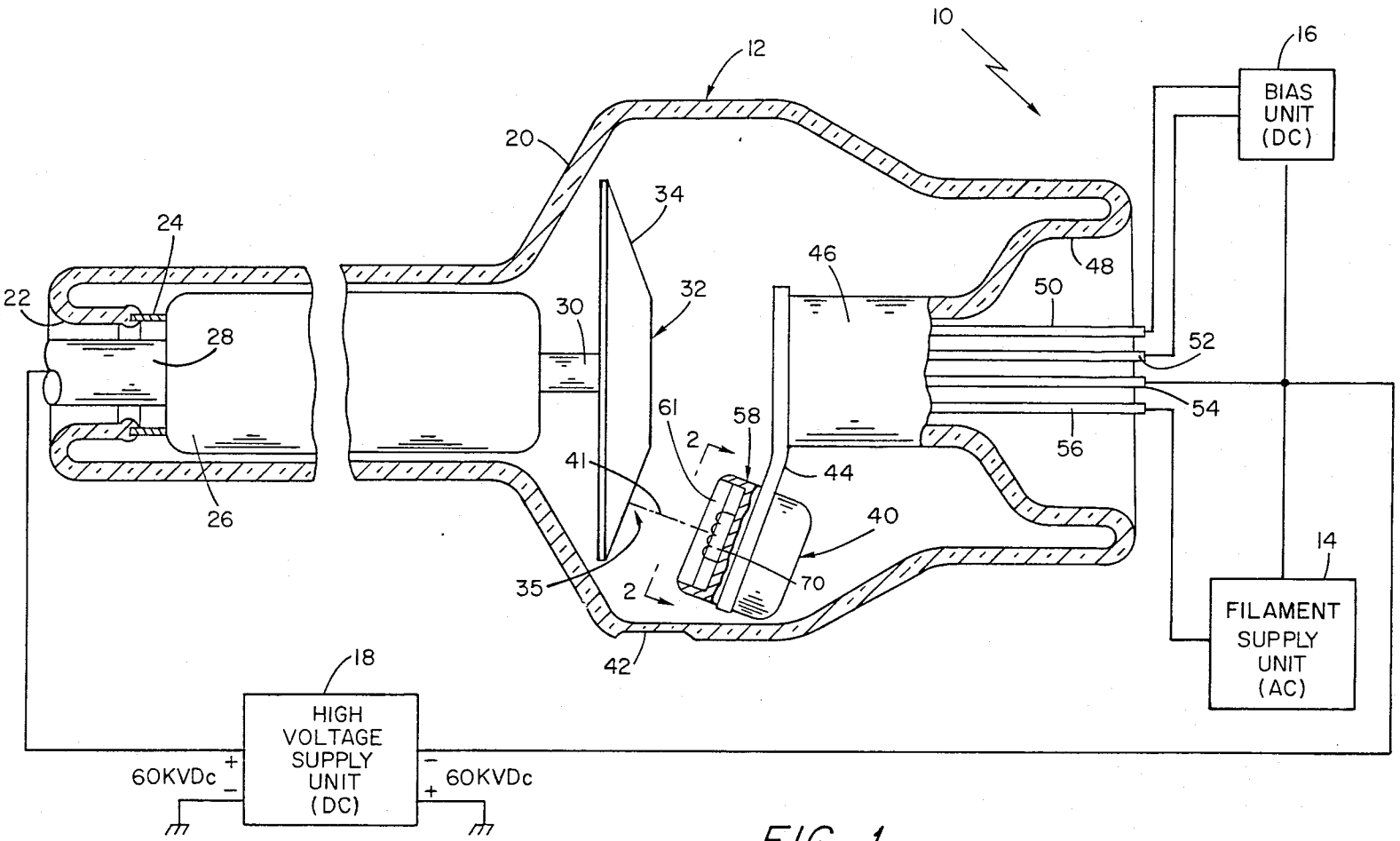
FIG. 1 is a partially sectioned plan view and schematic diagram of an x-ray tube embodying the present invention.
Figure 3:
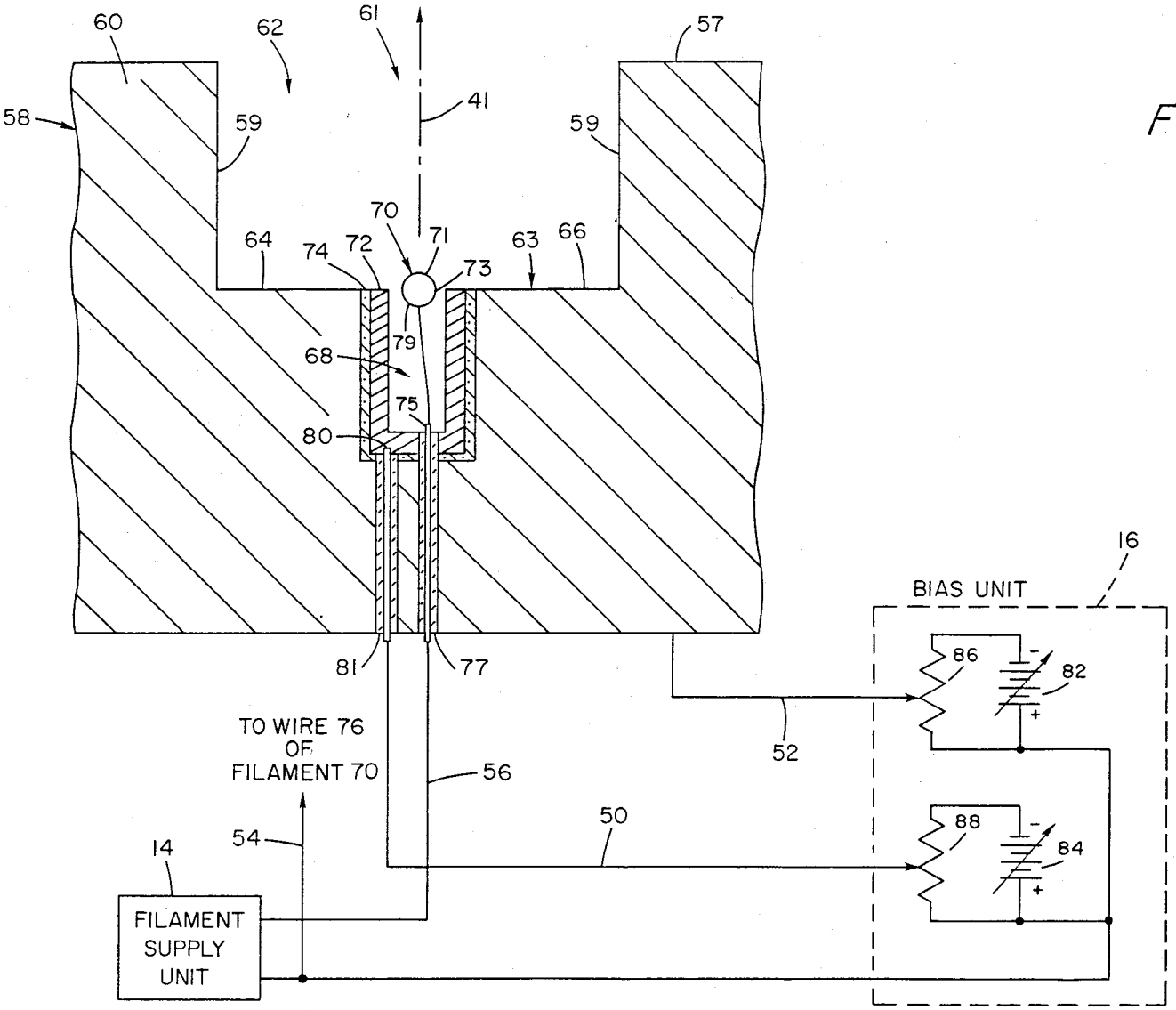
FIG. 3 is a cross-sectional view, taken along line 3—3 of FIG. 2, and schematic diagram of the cathode assembly of FIG. 2.

Referring now to FIG. 1, there is shown therein an x-ray generating apparatus 10 including an x-ray tube 12 electrically connected as shown to an adjustable filament supply unit 14, an adjustable bias unit 16, and an adjustable high voltage supply unit 18. X-ray tube 12 comprises anode 32 and the cathode assembly 40 of the present invention, the details of which will be described in detail hereinafter. Suffice it here to say that cathode assembly 40 comprises cathode body 58 supporting electron beam emitting means 70, here a helically-shaped filament, in an opening 61 of body 58. Filament 70 emits an electron beam in a manner to be described along a path or axis 41 toward a target surface 34 an anode 32, such electron beam being incident on such target surface 34 at an electron beam focal spot 35, such focal spot 35 having a length corresponding to the length of filament 70 and a width. Cathode body opening 61 comprises first cavity 62 and adjoining second cavity 68 disposed in the base 63 of first cavity 62 (see FIG. 3). Defining first cavity 62 at sides 59 and base 63 thereof is electrically conductive first focusing cup 60, as shown in FIG. 3. Second focusing cup 72 is also electrically conductive and is insulatingly disposed within second cavity 68, such second focusing cup 72 being electrically isolated from first focusing cup 60 by insulating layer 74. First and second focusing cups 60, 72 thus comprise separate regions of cathode body 58 and are held at different electrical DC potentials by bias unit 16, with first focusing cup 60 being held at negative DC voltage with respect to ground, here substantially equal to an electrical DC potential applied to filament 70 (by high voltage supply unit 18, as will be described), and second focusing cup 72 being set to a negative DC electrical potential with respect to filament 70. With such arrangement, electron emissions from selected portions of cathode filament 70 are suppressed by means, including second focusing cup 72, displaced from path 41, thereby substantially reducing the width of electron beam focal spot 35 by substantially eliminating the B-distribution from the focal spot 35 of the electron beam emitted by filament 70 and electrostatically focused onto anode 32 by first focusing cup 60. Hence, the size of such focal spot 35 is reduced without any substantial decrease in the total current of the electron beam incident on anode 32.

Referring again to FIG. 1, x-ray tube 12 comprises a generally tubular envelope 20 which may be made of dielectric material, such as lead-free glass, for example. One end of envelope 20 is provided with a reentrant portion 22 which is peripherally sealed to one end of a metal collar 24. The other end of collar 24 is hermetically attached, in a well-known manner, to one end of a conventional anode rotor 26 which is made of conductive material, such as copper, for example. A stem 28 of rotor 26 extends externally of the envelope 20 and provides terminal means for electrically connecting the rotor 26 to a positive terminal of adjustable high voltage DC supply unit 18. Here, high voltage supply unit 18 produces +60 KVDC with respect to ground at such positive terminal.

Within the envelope 20, a conductive shaft 30 made of refractory material, such as an alloy of titanium-zirconium-molybdenum (TZM), for example, extends longitudinally from the internal end of rotor 26 and is in electrical communication therewith. Fixedly attached to the opposite end of shaft 30 is a perpendicularly disposed anode disk 32 which is rotated by the shaft 30 in a well-known manner. The inner end of disk 32 has a frusto-conical configuration for providing a sloped annular target surface 34 adjacent to its outer periphery. Target surface 34 is made of a material, such as an alloy of tungsten and rhenium (W-Re), for example, which readily emits x-rays when bombarded by high energy electrons incident thereon from filamentary cathode 70 along beam axis 41. However, other portions of anode disk 32 may be made of suitable conductive material, such as TZM, for example.

Although anode disk 32 is rotatable, a portion of target surface 34 is continuously positioned in spaced, opposing relationship with cathode assembly 40 and is sloped toward a radially aligned x-ray transparent window 42 in envelope 20. Cathode assembly 40 is fixedly supported on a suitably angled end portion of a hollow arm 44 which has an opposing end portion hermetically attached to one end of an axially disposed support cylinder 46. The other end of support cylinder 46 is circumferentially sealed to a reentrant portion 48 of envelope 20, out of which hermetically extend electrical terminal lead members 50, 52, 54 and 56, respectively.

Terminal lead members 50 and 52 are electrically connected to respective output terminals of adjustable DC bias unit 16. Another output terminal of bias unit 16 is connected electrically to terminal lead member 54 in common with an output terminal of adjustable AC filament supply unit 14 and the negative output terminal of high DC voltage unit 18. Terminal lead member 56 of tube 12 is connected electrically to another respective output terminal of filament supply unit 14. Within envelope 20, terminal lead members 50, 52, 54 and 56, respectively, extend through the hollow arm 44 and into the cathode assembly 40.

Figure 2:
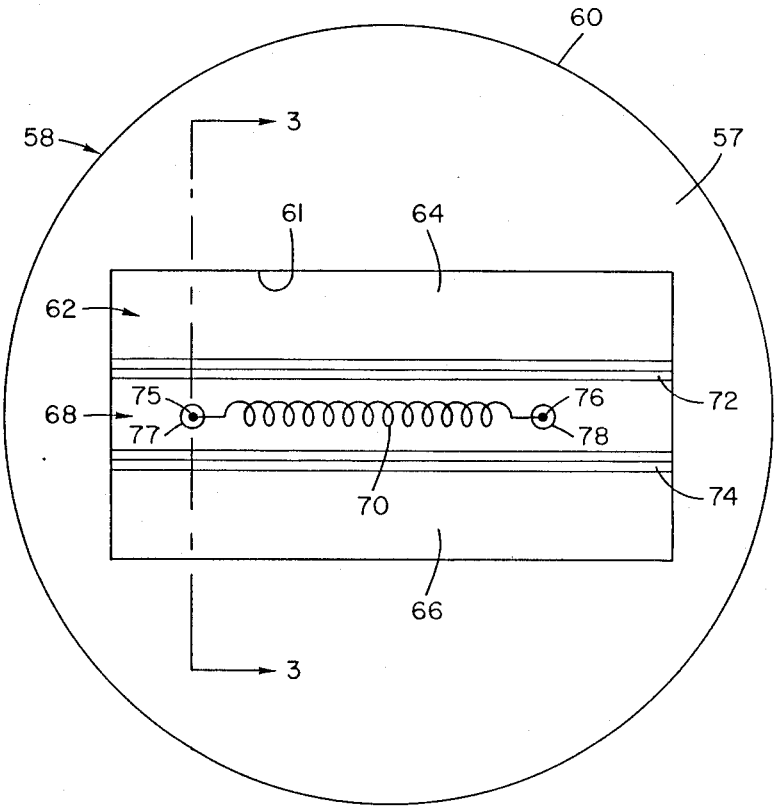
FIG. 2 is a plan view, taken along line 2—2 of FIG. 1, of the cathode assembly of the present invention and disposed in the x-ray tube of FIG. 1.

Referring additionally to FIGS. 2 and 3, cathode assembly 40 comprises cathode body 58 supporting filament 70 in an opening 61 thereof. Cathode body 58 comprises a generally cylindrical first focusing cup 60 made of conductive material, such as nickel, for example, and having an end surface 57 disposed in spaced opposing relationship with an arcuate portion of the sloped target surface 34. Slotted opening 61 comprises first rectangular cavity 62 diametrically disposed in end surface 57 of first focusing cup 60 and extending radially with respect to the target surface 34. First cavity 62 is defined by sides 59 and base 63, such base 63 comprising a coextensive pair of spaced, opposing steps 64, 66, respectively, which extend into a more narrow, second rectangular cavity 68 of opening 61, second cavity 68 being disposed diametrically in first focusing cup 60 of cathode body 58 and extending radially with respect to target surface 34. Second focusing cup 72 made of conductive material, such as nickel, is diametrically disposed within second cavity 68 and insulatingly spaced from first focusing cup 60 by electrically nonconductive layer 74. Layer 74 is made from any suitable insulating material, here hafnium-oxide, but other suitable insulating material, such as aluminum oxide, may alternately be used. Thus, it is seen that second focusing cup 72 is insulatingly disposed within first focusing cup 60. As shown in FIG. 3, second focusing cup 72 terminates coextensively with the adjacent corners of steps 64, 66, respectively. Axially disposed in opening 61 and insulatingly spaced from second focusing cup 72 is a helically wound filament 70 which is made of suitable electron emitting material, such as tungsten, for example. As shown in FIG. 1, filament 70 is disposed transversely with respect to anode target surface 34. That is, the length of such helical filament 70 is substantially parallel to such anode target surface 34.

Filament 70 is insulatingly supported in opening 61 near the junction of cavities 62, 68 by opposing end portions thereof being fixedly attached, as by welding, for example, to end portions of respective wires 75, 76. Wires 75, 76 are axially supported in respective bushings 77, 78 which are made of dielectric material, such as ceramic, for example, and which extend from an opposing closed end surface of first focusing cup 60 through insulating layer 74 and second focusing cup 72. The opposing end portions of wires 75, 76 protrude insulatingly from the other ends of dielectric bushings 76 and 78, respectively, and are electrically connected by conventional means to respective terminal lead members 56, 54. Thus, the wires 75, 76 provide conductive means for sending an alternating electrical current from the AC filament supply unit 14 through the filament 70 to heat it to a desired electron emitting temperature during operation of tube 12. Also, since the terminal lead member 54 is connected electrically to the negative terminal of high DC voltage supply unit 18 (FIG. 1) the wire 76 serves to maintain the filament 70 negative with respect to the anode disk 32. To put it another way, terminal lead member 54, and hence filament 70, is held at the same DC potential as the negative DC voltage output of high voltage supply 18 (here, −60 KVDC). As a result, the electrons emitted from filament 70 are electrically drawn in a beam along path 41 (FIG. 1) toward the aligned portion of the sloped target surface 34, which is held at a high positive DC voltage (here, +60 KVDC) by the positive DC voltage output of high voltage supply 18.

First focusing cup 60 is electrically connected to a first output terminal of bias unit 16 via a conventional electrical connection, such as welding, between first focusing cup 60 and terminal lead member 52. Wire 80 is electrically connected by conventional means, such as welding, to the base portion of second focusing cup 72, as shown in FIG. 3. Wire 80 passes axially through insulating bushing 81 which is made, for example, from ceramic material and extends through first focusing cup 60 to the closed end surface thereof. Wire 80 protrudes from bushing 81 at the closed end surface of first focusing cup 60 and is connected by conventional means to terminal lead member 50, thereby electrically coupling second focusing cup 72 to a second output terminal of bias unit 16. Thus it is seen that first and second focusing cups 60, 72, which are electrically insulated from each other by insulating layer 74, comprise first and second, electrically isolated electrodes and may be independently set to predetermined, different electrical potentials by bias unit 16. Further, since a third output terminal of bias unit 16 is electrically connected to terminal lead member 54 (and hence to the negative DC voltage output of high voltage supply 18 and one end of filament 70), first and second focusing cups 60, 72 may each be biased positively or negatively, as desired, with respect to the high negative DC voltage to which filamentary cathode 70 is set.

Bias unit 16 here comprises a pair of independent, adjustable DC power supplies 82, 84 having the positive terminals thereof connected in common and to terminal lead member 54, as shown. Thus, here power supplies 82, 84 produce negative voltages on terminal lead members 52, 50 with respect to the negative DC potential output of high voltage unit 18. Connected across the terminals of power supply 82 is an adjustable resistive element or potentiometer 86. Likewise, potentiometer 88 is connected across the terminals of power supply 84. The movable taps of potentiometers 86, 88 are electrically coupled to terminal lead members 52, 50, respectively.

In operation, power supply 82 and potentiometer 86 are adjusted to produce a DC potential on terminal lead member 52, here approximately equal to the negative DC voltage output of high voltage unit 18 applied to filament 70. Here, such potential is approximately −60 KVDC with respect to ground. However, a positive DC voltage with respect to filament 70 may alternately be produced on lead 52, as is known. The electrical potential applied on terminal lead member 52 biases first focusing cup 60 to such electrical potential. That is, first focusing cup 60 acquires such voltage with respect to filament 70. It is noted that high voltage supply unit 18 applies a high positive potential, here approximately +60 KVDC with respect to ground, to anode 32, thereby establishing a large potential difference (approximately 120 KVDC) between filamentary cathode 70 and anode target area 34. Simultaneously, AC filament supply unit 14 supplies an AC signal, here approximately 10 VAC, to filament 70, the AC current passing through such filament 70 heating such filament 70 to a temperature sufficient to cause filament 70 to emit electrons. The emitted electrons are drawn along path 41 as an electron beam toward anode target area 34 by the high potential difference between filament 70 and anode 32. The bombardment of such electron beam on tungsten-rhenium target area 34 produces x-rays, such produced x-rays propagating out of x-ray tube 12 through window 42 (FIG. 1). The voltage applied to first focusing cup 60 (here, −60 KVDC with respect to ground) provides electrostatic focusing to force the electron beam emitted by filamentary cathode 70 to converge at a predetermined region of target area 34—the electron beam focal spot 35.

Figure 4A:
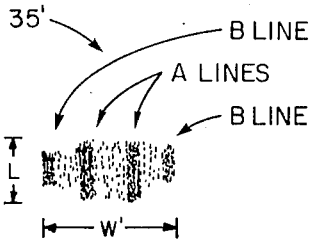
FIG. 4A PRIOR ART
FIG. 4A illustrates the electron distribution of an electron beam focused by a cathode assembly of the prior art.
Figure 4B:
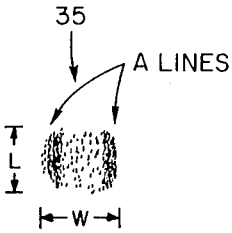
FIG. 4B illustrates the electron distribution of an electron beam focused by the cathode assembly of the present invention.

Referring now to FIG. 4A, shown is the electron distribution of the focal spot 35' of an electron beam focused on the anode target area by cathode assemblies of the prior art, in which the second focusing cup 72 included in the present invention was not provided and only a single potential, that fed to focusing cup 60, was applied to focus the electron beam emitted by filamentary cathode 70. As shown, such focal spot 35' has a length dimension L, corresponding to the length of filament 70, and a width dimension W'. The width W' of the electron distribution of focal spot 35' comprises a central portion, referred to as the A-distribution and bounded by A-lines, which are areas of relatively intense electron concentration, and a pair of peripheral portions, known as the B-distribution, such B-distribution being located on either side of the central A-distribution portion and being bounded by B-lines, which are areas of relatively intense electron concentration. It has been found that the electrons which form the A-distribution are emitted from the front portion 71 (FIG. 3), with respect to anode 32, of transversely-disposed filamentary cathode 70 and contribute the predominant amount of electron beam current emitted by filament 70. It has further been found that electrons emitted from side portions 73 and rear portions 79, with respect to anode 32, of filament 70 produce the B-distribution while contributing relatively little to the total electron beam current produced by filament 70. The apparatus of the present invention, specifically first and second focusing cups 60, 72 held to predetermined electrical potentials with respect to filamentary cathode 70 and displaced from the path 41 of the electron beam, substantially eliminates the emission of electrons from side portions 73 and rear portions 79 of filament 70, thereby substantially eliminating the B-distribution from the electron distribution of the electron beam focused on focal spot 35 of anode target area 34, as shown in FIG. 4B. Hence, the width dimension W of the electron distribution of focal spot 35 is significantly reduced, thereby greatly reducing the size of such focal spot 35. The emission of electrons from the front portion 71 of filamentary cathode 70 is not significantly suppressed, however. Thus, the area of such focal spot 35 is reduced from that of FIG. 4A without substantially decreasing the current of the focused electron beam, and hence without reducing the intensity of the x-rays produced by the bombardment of the target area 34 by such focused electron beam. Moreover, unlike the above-discussed U.S. Pat. No. 3,646,379, such area reduction is achieved without blocking electron emission from the length of filament 70. Thus, the length L of focal spot 35 remains unchanged.

More particularly, in the present invention, second focusing cup 72 is electrically isolated from first focusing cup 60 by electrically nonconducting layer 74, as discussed. Thus, second focusing cup 72 held at a predetermined DC potential independently of the −60 KVDC potential here applied to first focusing cup 60. Here, power supply 84 and potentiometer 88 are adjusted to produce an electrical DC potential on second focusing cup 72 (via terminal lead member 50) which is negative with respect to the electrical DC potential applied to filamentary cathode 70 (here, −60 KVDC with respect to ground) by high voltage unit 18. Here, second focusing cup 72 is biased in the above-described manner at between −150 VDC and −300 VDC with respect to filament 70 (and thus at between −60.15 KVDC and −60.30 KVDC with respect to ground). The presence of a greater negative electrical potential in the proximity of side regions 73 and rear regions 79 of filamentary cathode 70 tends to repel electrons emitted from such regions 73, 79 back to filament 70. In other words, setting second focusing cup 72 to a DC potential more negative than that of filamentary cathode 70 suppresses the emission of electrons from selected regions of filament 70, here side regions 73 and rear regions 79. Thus, the B-distribution (and associated B-lines) in the resultant electron distribution at electron beam focal spot 35 is substantially eliminated, as shown in FIG. 4B, and the width W of such electron beam focal spot 35 thereby reduced. Thus, the area of focal spot 35 is decreased. As discussed, B-distribution electrons have been found to contribute little to electron beam current. Therefore, such current is not substantially reduced by suppression of electron emissions from side portions 73 and rear portions 79 of filamentary cathode 70. Increasing the negative DC potential difference between second focusing cup 72 and filament 70 increases the degree of electron-emission-suppression from filament 70, thereby further eliminating B-distribution from electron beam focal spot 35. At some point, however, further increase in the negative DC potential of second focusing cup 72 with respect to filament 70 causes unwanted suppression of electron emission from front portions 71 of filament 70 (and hence of A-distribution at electron beam focal spot 35), reducing electron beam current while maintaining the size of focal spot 35 substantially unchanged. Such "overbiasing" of second focusing cup 72 is to be avoided.

Figure 5:
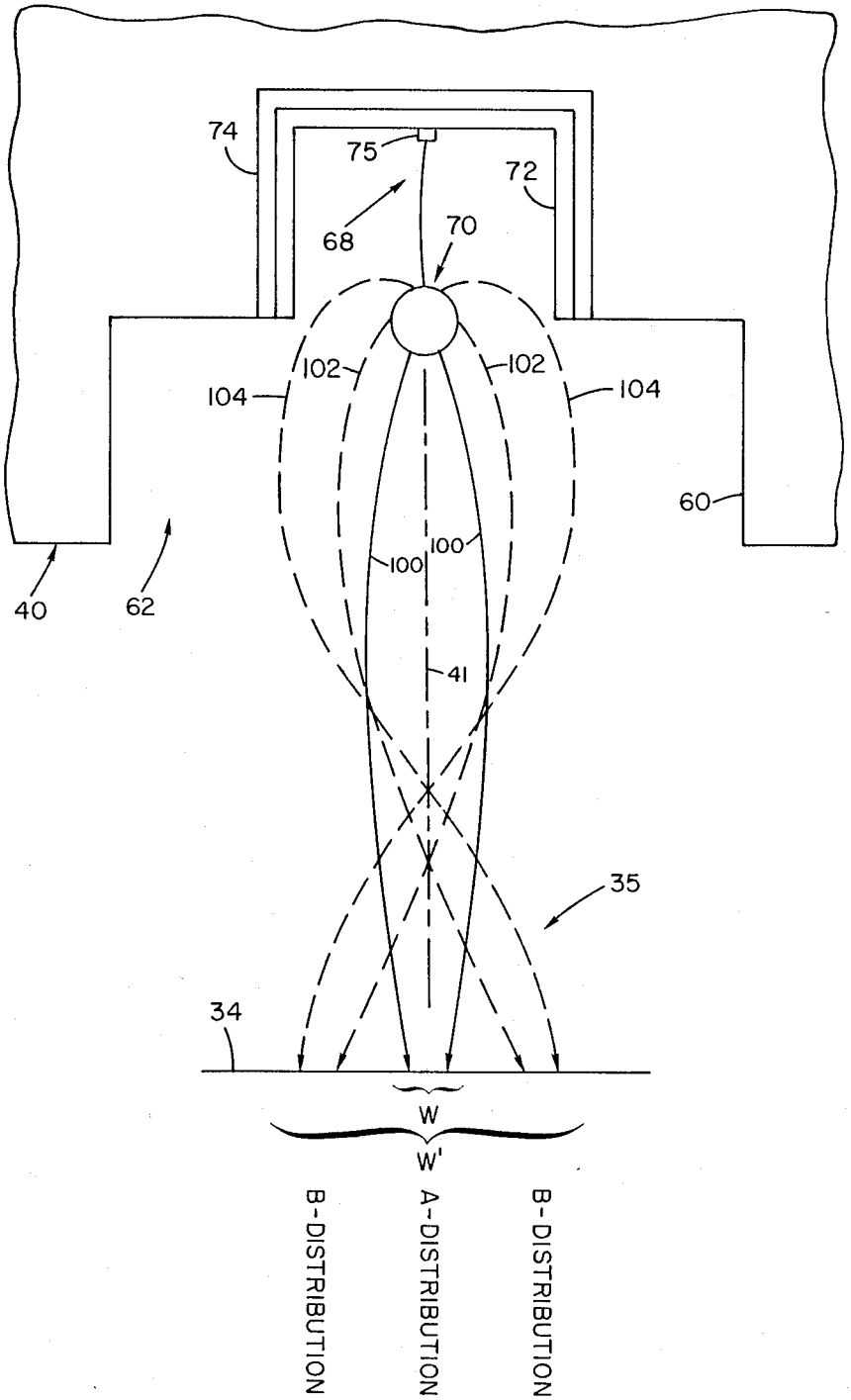
FIG. 5 is an end-on view of the cathode assembly of FIG. 3 and is illustrative of the operation thereof.

Referring to FIG. 5, an end-on view of cathode assembly 40 and anode target surface 34 is shown with the distance therebetween reduced, and the size of focal spot 35 increased, for illustrative purposes. Electrons emitted from the front portion (71, see FIG. 3) of filamentary cathode 70 are represented by paths 100 and are electrostatically focused onto anode target surface 34 by first focusing cup 60. Such electron emissions 100 become the A-distribution of electron beam focal spot 35 on target surface 34. Electron emissions from side and rear portions (73, 79, see FIG. 3) of filament 70 are depicted by paths 102, 104, respectively, shown in phantom to emphasize that such emissions are substantially eliminated with the present invention. However, electrons which would travel such paths 102, 104 would be electrostatically focused onto target area 34 to become the B-distribution of electron beam focal spot 35. Prior art focusing methods varied the geometry of slots 62, 68, the location of filament 70 therein, and the spacing between filament 70 and target surface 34 to reduce the size of focal spot 35. Changes in such spacing affects the size of the A- and B-distributions oppositely. Thus, altering the spacing between filament 70 and target surface 34 to decrease the size of the A-distribution of electron beam focal spot 35 increases B-distribution size. The reason for this is that the electron emissions 102, 104 which form such B-distribution are "overfocused" by focusing cup 60, that is, paths 102, 104 cross beam axis 41. The apparatus of the present invention, by including insulated, independently biased second focusing cup 72 biased as described above, selectively eliminates electron emissions from the side and rear portions 73, 79 (FIG. 3) of filament 70, thereby substantially eliminating electron emission along paths 102, 104. Thus, the focal spot 35 comprises only A-distribution electrons and contains no B-distribution electrons. Therefore, parameters such as the geometry of slots 62, 68, the location of filament 70 within such slots 62, 68, and the spacing between filamentary cathode 70 and anode target surface 34 may be varied to achieve desired focal spot 35 size without experiencing any B-distribution at such focal spot 35. As a consequence, the diametric size of filamentary cathode may be increased, producing greater electron beam current, which may be focused to a small focal spot 35 containing only A-distribution electrons.

To summarize, the present invention provides apparatus for suppressing emission of electrons from selected portions, here side and rear portions 73, 79, of filamentary cathode 70, thereby substantially eliminating B-distribution from the electron distribution of the focal spot 35 of the produced electron beam incident on anode target surface 34, and hence reducing the width and area of such focal spot 35 on anode target surface 34. It is noted that such apparatus, comprising first and second, electrically isolated focusing cups 60, 72, is displaced from the path 41 of the electron beam emitted by filament 70 to anode target area 34. To put it another way, filamentary cathode 70 is disposed between second focusing cup 72 and anode 32. Thus, electron emissions along the length dimension of filament 70 are not blocked, and the electron beam current thereby remains substantially unchanged.

Having described a preferred embodiment of the present invention, other embodiments may become apparent to those skilled in the art. For example, the present invention has been described with reference to an "ungridded" cathode assembly 40, that is, an apparatus wherein first focusing cup 60 is held at the same DC potential as the filament 70 (here −60 KVDC with respect to ground). However, the invention may also be applied to a "gridded" cathode assembly wherein first focusing cup 60 is set at a different DC voltage than that applied to filament 70, with an independent bias voltage being applied to second focusing cup 72 to achieve elimination of the B-distribution from focal spot 35. Therefore, it is understood that the scope of the present invention is to be limited only by the scope of the appended claims.

What is claimed is:

1. A cathode assembly comprising:

means for emitting an electron beam in a path toward an anode, said emitting means having a predetermined length; and means, comprising an electrically conductive body having an opening disposed therein and supporting the emitting means longitudinally within the opening, for focusing the emitted electron beam onto a predetermined focal spot on the anode, said focusing means comprising an electrically conductive member, insulatingly disposed longitudinally within the opening along substantially the predetermined length of the emitting means, for substantially eliminating emission of electrons from selected portions of the electron beam emitting means.

2. The cathode assembly of claim 1 wherein said focusing means includes means for biasing said electrically conductive member to an electrical potential more negative than an electrical potential applied to the electron beam emitting means.

3. The cathode assembly of claim 2 wherein said opening comprises a first cavity and a second cavity recessed in the first cavity, said electron beam emitting means being disposed at a junction between the first and second cavities, said electrically conductive member being disposed within said second cavity.

4. A cathode assembly comprising:

(a) filament;

(b) a means for applying a first electrical potential to said filament;

(c) an electrically conductive cathode body comprising:

(i) a first region having a first opening disposed therein and supporting the filament within the first opening; and (ii) a second region, disposed within the first opening and substantially enclosed by the first region and electrically insulated from the first region, said second region comprising a second opening having portions of the filament disposed within the second opening;

(d) means for biasing said first region to a second electrical potential with respect to the first electrical potential and means for biasing said second region to a third electrical potential with respect to the first electrical poential, the third electrical potential being negative with respect to the first electrical potential.

5. The cathode assembly of claim 4 wherein said cathode body first opening comprises:

a first cavity bounded at wall portions thereof by said first cathode body region, said first cavity also having a base portion; and a second cavity disposed in the base portion of the first cavity, said second cathode body region bounding said second cavity.

6. An x-ray tube comprising:

a evacuated envelope;

an anode disposed within the evacuated envelope; and a cathode comprising:

(i) filamentary means, having a predetermined length, for emitting an electron beam in a path toward a target area of said anode; and (ii) means, comprising an electrically conductive body having an opening disposed therein and supporting the filamentary means longitudinally within the opening, for focusing said emitted electron beam onto a focal spot on sasid target area, said focusing means including an electrically conductive member, insulatingly disposed longitudinally within the opening along substantially the predetermined length of the filamentary means, for substantially eliminating emission of electrons from selected portions of said filamentary means to decrease the size of said focal spot.

7. The x-ray tube of claim 6 further comprising:

means for applying a first electrical potential to the filamentary means; and means for applying a second electrical potential to the electrically conductive member, said second electrical potential being negative with respect to the first electrical potential.

8. The x-ray tube of claim 7 further comprising:

means for applying a third electrical potential to said body.

9. The x-ray tube of claim 8 wherein the first and third electrical potentials are substantially equal.

10. The x-ray tube of claim 6 wherein said filamentary means is disposed between said electrically conductive member and said anode.

11. The x-ray tube of claim 10 wherein said opening comprises a first cavity and a second cavity disposed in a base of the first cavity, the electrically conductive member being disposed in the second cavity.

12. An x-ray tube comprising: an evacuated envelope; an anode disposed within the evacuated envelope; and a cathode disposed opposing said anode, said cathode comprising:

(i) filametnary means, having a predetermined length, for emitting an electron beam toward a target area of the anode, a first portion of said beam comprising electrons emitted by front portions of the filamentary emitting means, and a second portion of said beam comprising electrons emitted by side and rear portions, with respect to the anode, of the filamentary emitting means; and (ii) means, comprising an electrically conductive body supporting the filamentary means in an opening disposed therein, for focusing the emitted electron beam onto a focal spot of predetermined size on said target area, said focusing means including means for substantially eliminating emission of said second portion of the electron beam, said suppressing means comprising an electrode insulatingly disposed within the body opening adjacent said side and rear portions along substantially the predetermined length of the filamentary means.

13. An x-ray tube comprising:

an evacuated envelope;

an anode disposed within the evacuated envelope; a filament; means for applying a first electrical potential to said filament; and a cathode body having a first cavity disposed therein and second cavity recessed in the first cavity, said cathode body supporting the filament in the first and second cavities, said cathode body comprising a first electrode bounding the first cavity and a second electrode substantially enclosed by the first electrode and bounding the second cavity, the first and second electrodes being electrically isolated from each other;

means for applying a second electrical potential to the first electrode; and means for applying a third electrical potential to the second electrode, the third electrical potential being negative with respect to the first electrical potential.

14. An x-ray tube comprising:

an evacuated envelope;

an anode disposed within the evacuated envelope;

means for applying a positive electrical potential, with respect to ground, to the anode;

filamentary means for emitting an electron beam toward the anode, the filamentary means having a first negative electrical potential, with respect to ground, applied thereto;

means, comprising an electrically conductive body supporting the filamentary means longitudinally in an opening disposed therein and having the first negative electrical potential applied thereto, for focusing the electron beam onto said anode at a focal spot, the focal spot having a length, corresponding to the length of the filamentary means, and a width; and wherein said focusing means further comprises electrode means, insulatingly disposed within the body opening along substantially the length of the filamentary means and biased to a second negative electrical potential with respect to the first negative electrical potential, for reducing the width of the focal spot, said second negative electrical potential being selected to substantially eliminate emission of electrons from certain portions of the filamentary means.

15. The x-ray tube of claim 14 wherein the body opening comprises a first cavity bounded at a first portion thereof by the electrically conductive body, said first cavity being bounded at a second portion thereof by a wall having a second cavity disposed therein, said second cavity being bounded by said electrode means.

16. A cathode comprising:

(a) a first electrically conductive member having a cavity having a predetermined shape disposed longitudinally therein;

(b) a second electrically conductive member having said predetermined shape insulatingly disposed longitudinally with the cavity; and (c) a filament longitudinally disposed adjacent to the second electrically conductive member.

17. The cathode of claim 16 further comprising means for biasing the filament to a first electrical potential and biasing the second electrically conductive member to a second electrical potential negative with respect to the first electrical potential.

18. The cathode of claim 17 further comprising means for biasing the first electrically conductive member to substantially the first electrical potential.

19. An x-ray tube comprising:

(a) an evacuated envelope;

(b) an anode disposed within the evacuated envelope; and (c) a cathode disposed within the evacuated envelope, said cathode comprising:

(i) filamentary means for emitting an electron beam toward the anode;

(ii) a first electrically conductive member having a cavity having a predetermined shape disposed longitudinally therein; and (iii) a second electrically conductive member having substantially said predetermined shape insulatingly disposed longitudinally within the cavity, said second electrically conductive member supporting said filamentary means adjacent thereto.

20. The x-ray tube of claim 19 further comprising means for biasing the filament to a first electrical potential and biasing the second electrically conductive member to a second electrical potential negative with respect to the first electrical potential.

21. The x-ray tube of claim 20 further comprising means for biasing the first electrically conductive member to substantially the first electrically potential.

* * * * *